US006308535B1

(12) United States Patent
Sangiacomo

(10) Patent No.: US 6,308,535 B1
(45) Date of Patent: Oct. 30, 2001

(54) METHOD FOR THE MANUFACTURE OF DESIGNED KNITWEAR ON CIRCULAR STOCKING KNITTING AND KNITTING MACHINES

(75) Inventor: Fulvio Sangiacomo, Brescia (IT)

(73) Assignee: Sangiacomo S.p.A. (IT)

( * ) Notice: Subject to any disclaimer, the term of this patent is extended or adjusted under 35 U.S.C. 154(b) by 0 days.

(21) Appl. No.: 09/694,737

(22) Filed: Oct. 23, 2000

(51) Int. Cl.[7] ..... D04B 9/26
(52) U.S. Cl. ..... 66/8; 66/40; 66/215
(58) Field of Search ..... 66/8, 13, 12, 17, 66/20, 21, 25, 36, 40, 215, 222, 224, 228, 180, 181, 128 R

(56) References Cited

U.S. PATENT DOCUMENTS 2,573,117 * 10/1951 Thurston ..... 66/180
2,633,722 * 4/1953 Lorimer ..... 66/180
2,642,732 * 6/1953 Thurston ..... 66/180
2,917,912 * 12/1959 Levin ..... 66/180
2,934,921 * 5/1960 Green ..... 66/180
3,026,698 * 3/1962 Levin ..... 66/180
3,124,948 * 3/1964 Levin ..... 66/180
3,194,030 * 7/1965 Keziah ..... 66/180

* cited by examiner

*Primary Examiner*—Danny Worrell
(74) *Attorney, Agent, or Firm*—McGlew and Tuttle, P.C.

(57) ABSTRACT

A method for the manufacture of designed knitwear on circular stocking knitting and knitting machines is provided using one or more feed stations, starting from a first base yarn (13) and from a second base yarn (14) for the manufacture of a basic knit fabric and from at least one dyed yarn (15) to create a design in the basic knit fabric. Some needles (11) are selected to pick up and knit the dyed yarn (15) and the first base yarn (13) without picking up the second base yarn, while the remaining needles pick up and knit the second and first base yarns (13, 14), excluding the dyed yarn.

8 Claims, 1 Drawing Sheet

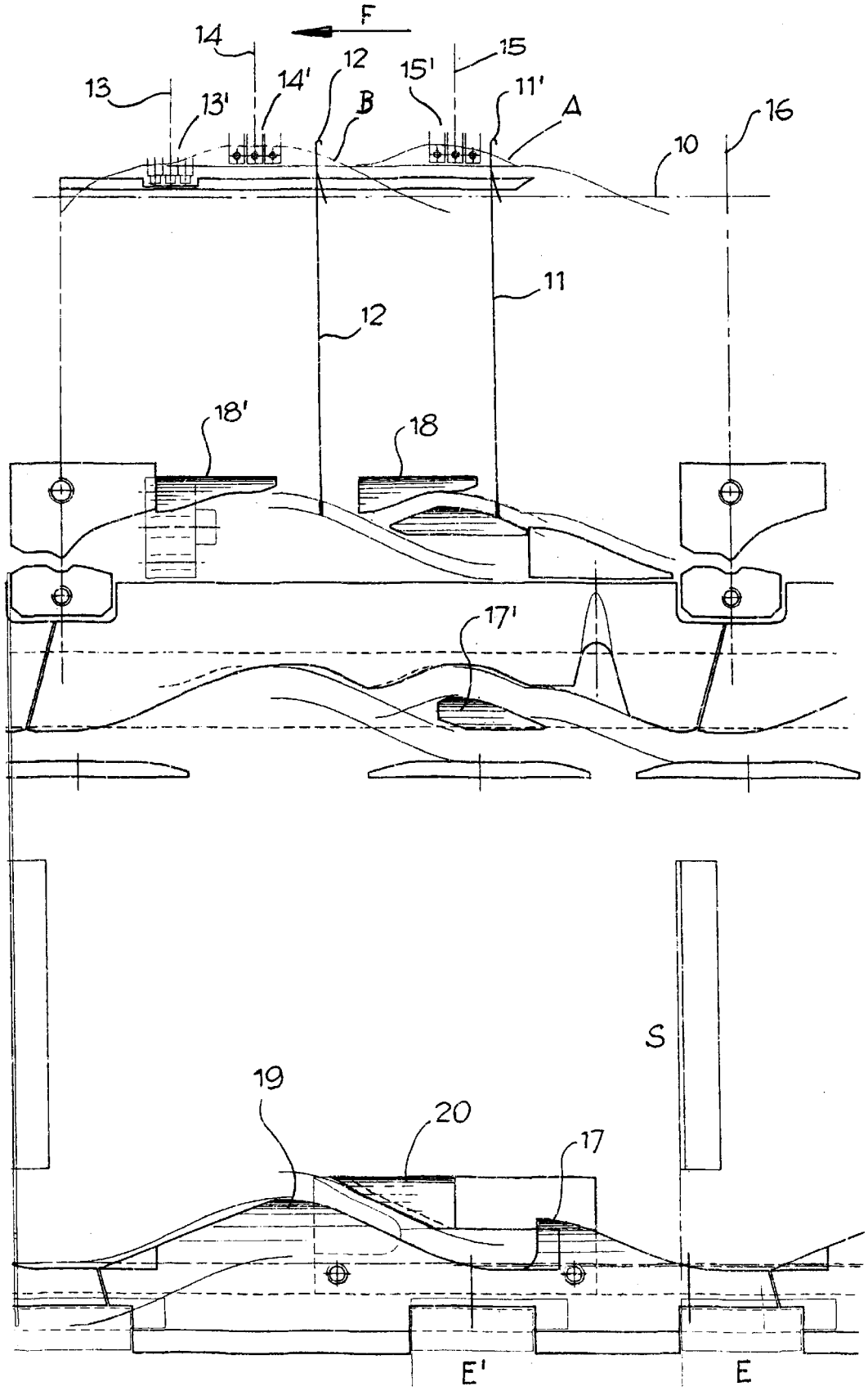
F
14
15
12
15'
13
14'
B
11'
A
16
13'
10
11
12
18'
18
17'
S
19
20
17
E'
E

METHOD FOR THE MANUFACTURE OF DESIGNED KNITWEAR ON CIRCULAR STOCKING KNITTING AND KNITTING MACHINES

FIELD OF THE INVENTION

The present invention pertains to the field of circular stocking knitting and knitting machines and pertains in particular to a method for the manufacture of designed knitwear on such machines.

BACKGROUND OF THE INVENTION

Various methods for the manufacture of designed knitwear on circular stocking knitting and knitting machines have already become known. One method, for example, consists of knitting with the needles of the machine at least one base yarn with, alternately, two natural yarns or two yarns of different color and with a dual selection of the needles which must form the design in the knitwear. Another method consists of knitting, in the missed stitch form, at least one base yarn with another yarn of a different color and/or type by means of a single selection of the needles that must form the design. However, the design that will thus be created in the knitted article has never been defined well and clearly, with the yarn of a different color and/or type being mixed together with the base yarn.

SUMMARY AND OBJECTS OF THE INVENTION

Thus, the object of the present invention is to propose a novel method for the manufacture of designed knitwear with only one selection of the needles, starting from a first base yarn (coarser), a second base yarn (or weft, finer than the first one) and a dyed yarn for the design. This method provides for picking up and knitting the two base yarns together in the undesigned sections of the article and for knitting the dyed yarn together with the first base yarn in the zone of the design, and discarding the second base yarn, in such a manner that the design becomes better defined, clearer, and has a solid color. The object is accomplished by selecting the needles that must form the design in the knitwear in such a way that each of them picks up and knits the dyed yarn and the first base yarn, releasing, or discarding, the second base yarn, while the remaining needles pick up and knit both of the base yarns, excluding the dyed yarn of the design.

The selection is made on a single selection unit with a first extraction of the jacks to put all of them in a position to follow a first ascending cam and to raise the corresponding needles and to be able to select the needles which must pick up the dyed yarn, while the remaining needles remain lowered and the corresponding jacks remain cancelled or returned to the initial non-ascending position, and with a second extraction with which all previously cancelled jacks follow a second ascending cam and raise the corresponding needles (which did not pick up the dyed yarn) at the level of pickup from the second base yarn, after which all the needles are driven to pick up the first base yarn before lowering the stitches.

Greater details of the present invention will become more evident from the description given below with reference to the attached schematic drawing according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The FIGURE is schematic drawing, showing in developed form, part of the cams for controlling the jacks and needles, as well as the arrangement of the yarn guides in a circular machine according to the present invention.

DESCRIPTION OF THE PREFERRED EMBODIMENT

Referring to the drawings in particular, the circular knitting machine is shown with a lowering plane ofthe platen 10, showing one ofthe selected needles 11 intended to form the design of the manufactured knitted article and one of the needles 12, which usually knit in the undesigned part ofthe same article. An oscillating lower needle, which can be moved radially between an inactive (returned) position and an active (extracted) position, is usually associated with each needle.

Also shown are a first base yarn 13 fed from a respective yarn guide 13', a second base yarn 14 fed from a respective yarn guide 14' and a dyed yarn 15 for the design fed from a respective yarn guide 15', corresponding to each station for feeding the needles and knitting.

The drawing additionally shows, on two levels, the cams for the ascending and descending movements of the jacks and the ascending and descending cams ofthe needles 11, 12. The arrow F indicates the direction of rotation ofthe jacks and respective needles in relation to the cams. S indicates a selection unit for each feed station.

The yarn guides 13', 14', 15' for supplying the yarns 13, 14 and 15 defined above are placed in this order when viewed in the direction opposite the direction of rotation F of the needles, with the yarn guide 13' for the first base yarn 13 arranged at a lower level compared with the other two yarn guides 14', 15'.

Also in the drawing, 16 indicates a zone of lowering the stitches previously made by all the needles selected and not selected.

In addition a first, solid line A indicates the course of the hook 11' of the selected needles 11 intended to pick up the dyed yarn 15. A second, dotted line B indicates in its turn the course of the hook 12' of the needles 12 not selected. The needles 12 not selected are intended to pick up the second base yarn 14. All the needles then proceed to a lower level for picking up the first base yarn 13, in order to all follow a common course up to the next lowering zone 16. Therefore, the selection of the needles occurs corresponding to a single zone S of the course of the needles.

To carry out the method of the present invention, after the zone of lowering the stitches that were previously manufactured, all the jacks are brought into the active position with a first extraction E, in a position to be intercepted by a first ascending cam 17 for the jacks. When they are in such a position, the jacks of the needles 11, intended to pick up the yarn of the design 15, are selected to remain active so as to then follow the first ascending cam 17 and to be raised by a respective lower-needle-raising cam 17' in order to raise the respective needles 11 correspondingly. The other jacks are cancelled or are returned into the initial inactive position. Thus, the needles selected 11 shall be obligated to follow the course A and to pick up the dyed yarn 15 from the yarn guide 15' to then be lowered by a descending cam 18 before these needles reach the yarn guide 14' of the first base yarn 14. The remaining needles 12, which are associated with the jacks cancelled after the first extraction, shall remain at a lower level without being able to pick up the dyed yarn 15. However, with a successive second extraction E' all the previously cancelled jacks are placed in a position to follow a second ascending cam 19 so as to raise the corresponding needles 12, which are previously at a lowered level so as not to pick up the dyed yarn, in order to follow the course B and to be able to pick up the second base yarn 14 at the level of the yarn guide 14' and to then be lowered by a second descending cam 18'.

It should be noted that, between the first 17 and the second 19 ascending cam of the jacks, there is a cam 20 for canceling the jacks that had been selected and had followed the first ascending cam 17 so as to prevent them from arriving at the second ascending cam.

Subsequently, all the needles 11 and 12, i.e., both those which have picked up only the dyed yarn and the others which have picked up only the second base yarn and which were lowered by the descending cams 18 and 18', respectively, pick up the first base yarn 13 from the lower yarn guide 13', then continuing towards the zone of lowering the previously made stitches.

Therefore, the needles selected 11 will pick up the dyed yarn and the first base yarn, forming the desired design, and the remaining needles 12 will pick up the second base yarn and the first base yarn for the manufacture, within the framework of an article, of the remaining undesigned part of the knitwear.

While a specific embodiment of the invention has been shown and described in detail to illustrate the application of the principles of the invention, it will be understood that the invention may be embodied otherwise without departing from such principles.

What is claimed is:

1. A method for the manufacture of designed knitwear on one of a circular stocking knitting machine and a knitting machine, the machine having one or more feed stations using a first base yarn and a second base yarn for the manufacture of a basic knit fabric and at least one dyed yarn in order to create a design in the basic knit fabric and with a selection unit, with jacks and needles that must pick up the dyed yarn for the formation of the design in or at each feed station, the method comprising the steps of:

selecting with a single selection unit the needles that must form the design in the knitwear so that each of needles that must form the design in the knitwear picks up and knits dyed yarn and the first base yarn without picking up the second base yarn, while the remaining needles pick up and knit the second and first base yarns, excluding the dyed yarn.

2. A method for the manufacture of designed knitwear in accordance with claim 1, wherein said step of selecting with a single selection unit comprises:

making a first extraction of all the jacks of the needles to put them, starting from an initial inactive position, in a position to follow a first ascending cam;

actively selecting the jacks of the needles which must be raised to a level for the picking up of the dyed yarn, canceling and bringing back the remaining jacks to the initial position to maintain the respective remaining needles in a lower position without reaching the dyed yarn;

making a second extraction of all the remaining previously cancelled jacks, to position the remaining previously cancelled jacks to follow a second ascending cam and to raise the respective needles to a level for picking up the second base yarn, while the needles selected to pick up the dyed yarn are lowered so as not to pick up the second base yarn;

leading all the needles which have picked up the dyed yarn and the second base yarn to a level for picking up the first base yarn before lowering the stitches previously made.

3. A method for the manufacture of designed knitwear in accordance with claim 1, further comprising the steps of:

feeding the dyed yarn and feeding the second base yarn at a level higher than the first base yarn;

raising, at different times, needles which must pick up the dyed yarn of the design and the needles which must pick up the second base yarn; and bringing all the needles to a level for picking up the first base yarn before reaching the level of lowering the stitches previously made.

4. A method for the manufacture of designed knitwear in accordance with claim 2, further comprising the steps of:

feeding the dyed yarn and feeding the second base yarn at a level higher than the first base yarn;

raising, at different times, needles which must pick up the dyed yarn of the design and the needles which must pick up the second base yarn; and bringing all the needles to a level for picking up the first base yarn before reaching the level of lowering the stitches previously made.

5. A circular stocking knitting machine or a knitting machine, comprising:

feed stations including a first base yarn feed station, a second base yarn feed station and at least one dyed yarn feed station for creating a design in the basic knit fabric;

a selection unit;

jacks; and needles that must pick up the dyed yarn for the formation of the design in or at each feed station, a selection of needles being made at the selection unit acting as a single selection unit to select the needles that must form the design in the knitwear so that each of needles that must form the design in the knitwear picks up and knits dyed yarn and the first base yarn without picking up the second base yarn, while the remaining needles pick up and knit the second and first base yarns, excluding the dyed yarn, said single selection unit selecting and controlling said needles to move the needles to pick up a dyed yarn of the design at times different from the remaining needles, starting from said single selection unit.

6. A method for the manufacture of designed knitwear on one of a circular stocking knitting machine and a knitting machine, the method comprising the steps of;

providing a feed station with a first base yarn and a second base yarn and at least one dyed yarn in order to create a design in the basic knit fabric;

providing a selection unit;

providing jacks and needles that must pick up the dyed yarn for the formation of the design in or at each feed station; and selecting with a single selection unit the needles that must form the design in the knitwear so that each of needles that must form the design in the knitwear picks up and knits dyed yarn and the first base yarn without picking up the second base yarn, while the remaining needles pick up and knit the second and first base yarns, excluding the dyed yarn.

7. A method for the manufacture of designed knitwear in accordance with claim 6, wherein said step of selecting with a single selection unit comprises:

making a first extraction of all the jacks of the needles to put them, starting from an initial inactive position, in a position to follow a first ascending cam;

actively selecting the jacks of the needles which must be raised to a level for the picking up of the dyed yarn, canceling and bringing back the remaining jacks to the initial position to maintain the respective remaining needles in a lower position without reaching the dyed yarn;

making a second extraction of all the remaining previously cancelled jacks, to position the remaining previously cancelled jacks to follow a second ascending cam and to raise the respective needles to a level for picking up the second base yarn, while the needles selected to pick up the dyed yarn are lowered so as not to pick up the second base yarn;

leading all the needles which have picked up the dyed yarn and the second base yarn to a level for picking up the first base yarn before lowering the stitches previously made.

8. A method for the manufacture of designed knitwear in accordance with claim 6, further comprising the steps of:

feeding the dyed yarn and feeding the second base yarn at a level higher than the first base yarn;

raising, at different times, needles which must pick up the dyed yarn of the design and the needles which must pick up the second base yarn; and bringing all the needles to a level for picking up the first base yarn before reaching the level of lowering the stitches previously made.

* * * * *